US008499667B2

(12) United States Patent
Johnson et al.

(10) Patent No.: US 8,499,667 B2
(45) Date of Patent: Aug. 6, 2013

(54) TOOL HOLDER

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: WAGIC, Inc, Los Gatos, CA (US)

( * ) Notice: Subject to any disclaimer, the term of this patent is extended or adjusted under 35 U.S.C. 154(b) by 0 days.

(21) Appl. No.: 12/009,532

(22) Filed: Jan. 17, 2008

(65) Prior Publication Data

US 2009/0183607 A1 Jul. 23, 2009

(51) Int. Cl.
*B25B 23/16* (2006.01)

(52) U.S. Cl.
USPC ..... 81/177.2; 81/177.1

(58) Field of Classification Search
USPC ..... 81/73, 177.2, 28, 30, 124.7, 177.5, 81/177.85, 180.1, 177.1; 16/110.1, 111.1, 16/422, 426, 427, 421
See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | Laforge |
| 580,235 | A | 4/1897 | Strum |
| 647,528 | A | 4/1900 | Schmidt |
| 763,745 | A | 6/1904 | Gheen |
| 873,363 | A | 12/1907 | Ross |
| 875,493 | A | 12/1907 | Beard |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,842 | A | 6/1916 | Kaas |
| D53,597 | S | 7/1919 | Marcmann |
| 1,337,769 | A | 4/1920 | Hemming |
| 1,398,583 | A | 11/1921 | Bovee |
| 1,425,270 | A | 8/1922 | Morgan |

(Continued)

FOREIGN PATENT DOCUMENTS

| | | |
|---|---|---|
| CA | 1 147 176 | 5/1983 |
| DE | 24 53 480 A1 | 5/1976 |

(Continued)

*Primary Examiner* — Robert Scruggs
(74) *Attorney, Agent, or Firm* — Haverstock & Owens LLP

(57) ABSTRACT

A tool handle includes a cavity to receive a T-handle tool. When the tool handle is placed on the T-handle tool, the tool handle provides a better grip of the tool handle to apply greater torque. The tool handle includes a protrusion which is able to detachably couple with the T-handle tool. Once coupled with the T-handle tool, the tool handle is able to be grasped by a user to rapidly turn the T-handle tool. In some embodiments, the T-handle tool includes an added tool. A tool container is able to store T-handle tools and the tool handle. The tool container includes a locking mechanism to lock the tools in place and a tamper prevention mechanism to ensure the locking mechanism is not tampered with while the tool container is in the store.

16 Claims, 12 Drawing Sheets

U.S. PATENT DOCUMENTS

| | | | | |
|---|---|---|---|---|
| 1,500,852 | A | 7/1924 | Shepard | |
| 1,502,044 | A | 7/1924 | McCann | |
| 1,530,905 | A | 3/1925 | Nance | |
| 1,559,097 | A | 10/1925 | Hill | |
| 1,753,026 | A | 4/1930 | Rosati | |
| 1,825,936 | A | 10/1931 | Bodmer | |
| 1,888,222 | A | 11/1932 | Curtis et al. | |
| 1,915,245 | A | 6/1933 | Cook | |
| 1,944,606 | A | 1/1934 | Little | |
| 1,970,409 | A * | 8/1934 | Wiedemann | 81/30 |
| 2,236,333 | A | 3/1941 | Cowles | |
| 2,332,656 | A | 10/1943 | Mirando | 30/22 |
| 2,346,364 | A | 4/1944 | Dowe | 279/83 |
| D142,982 | S | 11/1945 | Bloomfield | |
| 2,409,613 | A | 10/1946 | Brooks | 306/32 |
| 2,410,971 | A | 11/1946 | Hartley | |
| 2,465,152 | A | 3/1949 | Ellison | |
| 2,465,619 | A | 3/1949 | Veit | 306/32 |
| 2,475,268 | A | 7/1949 | Wittle | 279/14 |
| 2,485,991 | A | 10/1949 | Stowell | |
| D156,677 | S | 12/1949 | Smith | D17/14 |
| D157,154 | S | 2/1950 | Horton | D58/11 |
| 2,509,507 | A | 5/1950 | Kane | |
| 2,512,967 | A | 6/1950 | Quiron | 145/50 |
| 2,530,024 | A | 11/1950 | Moody | 206/17 |
| 2,532,636 | A | 12/1950 | Minnich | 206/16 |
| 2,569,069 | A | 9/1951 | Motel | 145/50 |
| 2,590,307 | A | 3/1952 | Gibson | |
| 2,593,828 | A | 4/1952 | Arey | 81/177 |
| 2,604,211 | A | 7/1952 | Steine | |
| 2,701,052 | A | 2/1955 | Martel | |
| D175,056 | S | 6/1955 | Wilson | |
| 2,715,028 | A | 8/1955 | Dossie | 279/9 |
| 2,719,042 | A | 9/1955 | Epsy | 279/9 |
| 2,776,589 | A | 1/1957 | Gregory | |
| 2,778,396 | A | 1/1957 | Swain | |
| D179,979 | S | 4/1957 | Noga | |
| 2,800,816 | A | 7/1957 | Tasciotti | |
| 2,804,970 | A | 9/1957 | Kuc et al. | 206/16 |
| 2,810,472 | A | 10/1957 | Midkiff | |
| 2,836,210 | A | 5/1958 | Garofalo | |
| 2,842,020 | A | 7/1958 | Tarquinio | 81/177 |
| 2,844,244 | A | 7/1958 | Hanson | |
| 2,854,741 | A | 10/1958 | Cholger | |
| 2,878,701 | A | 3/1959 | Weersma | |
| 3,023,054 | A | 2/1962 | Shigekuni | |
| 3,061,927 | A | 11/1962 | Von Frankenberg Und Ludwigsdorf | 30/156 |
| 3,113,479 | A | 12/1963 | Swingle | 81/177 |
| 3,156,143 | A | 11/1964 | Wolf | |
| 3,222,959 | A | 12/1965 | Clark | |
| 3,255,792 | A | 6/1966 | Beck | |
| 3,257,991 | A | 6/1966 | Mosch | 120/1 |
| D205,745 | S | 9/1966 | Nannfeldt | D80/9 |
| 3,342,229 | A | 9/1967 | Janes | |
| 3,343,434 | A | 9/1967 | Schroeder | |
| 3,424,039 | A | 1/1969 | Scott | |
| 3,592,086 | A | 7/1971 | Derwin | 81/177 A |
| 3,654,975 | A | 4/1972 | Ballsmith et al. | |
| 3,667,518 | A | 6/1972 | Stillwagon, Jr. | |
| 3,802,286 | A | 4/1974 | Winklhofer et al. | 74/242.11 S |
| 3,863,693 | A | 2/1975 | Carriker | |
| 3,943,801 | A | 3/1976 | Yates | 81/71 |
| 3,958,469 | A | 5/1976 | Meese | |
| 3,997,053 | A | 12/1976 | Bondhus | |
| 4,000,767 | A | 1/1977 | Geng | |
| 4,043,230 | A | 8/1977 | Scrivens | 81/177 A |
| 4,154,125 | A | 5/1979 | Frank | 74/553 |
| 4,196,761 | A | 4/1980 | Royer | |
| 4,227,430 | A | 10/1980 | Jansson et al. | 81/177 M |
| 4,235,269 | A | 11/1980 | Kraus | |
| 4,238,862 | A | 12/1980 | Leatherman | |
| 4,241,773 | A | 12/1980 | Personnat | |
| 4,302,990 | A | 12/1981 | Chrichton et al. | 81/60 |
| 4,308,770 | A | 1/1982 | MacDonald | |
| 4,327,790 | A | 5/1982 | Stevens et al. | |
| 4,384,499 | A | 5/1983 | Shockley | 81/440 |
| D270,024 | S | 8/1983 | Strasser | |
| 4,424,728 | A | 1/1984 | MacDonald | 81/177 |
| 4,448,097 | A | 5/1984 | Rocca | |
| 4,469,109 | A | 9/1984 | Mehl | |
| 4,476,751 | A | 10/1984 | Mishima | |
| 4,525,889 | A | 7/1985 | Dunau | |
| 4,542,667 | A | 9/1985 | Jang | |
| 4,699,020 | A * | 10/1987 | Bush et al. | 74/544 |
| 4,703,673 | A | 11/1987 | Allen | |
| 4,711,353 | A | 12/1987 | Rozmestor | 206/378 |
| 4,716,795 | A | 1/1988 | Corona et al. | 81/177.4 |
| 4,716,796 | A | 1/1988 | Corona et al. | 81/177.4 |
| 4,767,006 | A | 8/1988 | Wasem | |
| 4,783,867 | A | 11/1988 | Tsao | |
| 4,787,276 | A | 11/1988 | Condon | 81/177.1 |
| 4,815,346 | A | 3/1989 | Littlehorn | |
| 4,819,523 | A * | 4/1989 | Souza | 81/177.2 |
| 4,819,800 | A | 4/1989 | Wilson | |
| 4,820,090 | A | 4/1989 | Chen | 408/241 R |
| D302,102 | S | 7/1989 | Amagaya | |
| 4,882,841 | A | 11/1989 | Margolis | 30/125 |
| 4,926,721 | A | 5/1990 | Hsiao | 81/177.4 |
| D308,462 | S | 6/1990 | Komatsu | D8/105 |
| 4,934,223 | A | 6/1990 | Wong | 81/490 |
| D310,770 | S | 9/1990 | Zamarripa | |
| D311,124 | S | 10/1990 | Learney | |
| 4,960,016 | A | 10/1990 | Seals | |
| 4,974,477 | A | 12/1990 | Anderson | |
| 4,979,407 | A | 12/1990 | Hernandez et al. | 81/3.09 |
| 5,029,707 | A | 7/1991 | Feng | 206/374 |
| 5,036,975 | A | 8/1991 | Chow | |
| 5,062,173 | A | 11/1991 | Collins et al. | 7/118 |
| 5,063,796 | A | 11/1991 | Gennep | |
| 5,065,487 | A | 11/1991 | Yother | |
| 5,086,674 | A | 2/1992 | Her | |
| 5,146,815 | A | 9/1992 | Scott, III | 81/437 |
| 5,147,038 | A | 9/1992 | Pergeau | |
| D333,769 | S | 3/1993 | Jureckson | D8/71 |
| D334,516 | S | 4/1993 | Tsunoda | D8/29 |
| D339,048 | S | 9/1993 | Baum | D8/107 |
| 5,263,389 | A | 11/1993 | Frazzell et al. | 81/124.3 |
| 5,265,504 | A | 11/1993 | Fruhm | 81/439 |
| D342,433 | S | 12/1993 | Sorenson | D8/107 |
| 5,271,300 | A | 12/1993 | Zurbuchen et al. | 81/124.4 |
| D343,106 | S | 1/1994 | Eklind et al. | D8/71 |
| 5,295,422 | A | 3/1994 | Chow | |
| 5,320,004 | A | 6/1994 | Hsiao | 81/440 |
| 5,329,834 | A | 7/1994 | Wong | 81/58.3 |
| 5,394,984 | A | 3/1995 | Aiba | |
| D359,671 | S | 6/1995 | Acosta | |
| 5,450,774 | A | 9/1995 | Chang | 81/440 |
| 5,450,775 | A | 9/1995 | Kozak | 81/440 |
| 5,461,950 | A | 10/1995 | Iwinski | |
| D365,681 | S | 1/1996 | Chow | |
| 5,480,166 | A | 1/1996 | Milsop | |
| 5,495,942 | A | 3/1996 | Izhak | 206/372 |
| 5,499,560 | A | 3/1996 | Aeschliman | |
| 5,499,562 | A | 3/1996 | Feng | 81/177.4 |
| 5,517,885 | A | 5/1996 | Feng | 81/177.4 |
| 5,522,291 | A | 6/1996 | Liu | 81/490 |
| 5,535,882 | A | 7/1996 | Liu | 206/377 |
| D373,943 | S | 9/1996 | Fuhrmann | D8/71 |
| 5,553,340 | A | 9/1996 | Brown, Jr. | 7/118 |
| 5,566,596 | A | 10/1996 | Lin | 81/490 |
| D376,520 | S | 12/1996 | Morin | D8/14 |
| 5,581,834 | A | 12/1996 | Collins | 7/118 |
| D377,444 | S | 1/1997 | Lin | D8/107 |
| 5,592,859 | A | 1/1997 | Johnson et al. | 81/177.4 |
| D378,797 | S | 4/1997 | Poremba et al. | D8/107 |
| D380,131 | S | 6/1997 | Sung | |
| D382,190 | S | 8/1997 | Blackston et al. | D8/107 |
| 5,653,525 | A | 8/1997 | Park | |
| D383,048 | S | 9/1997 | Sorenson et al. | D8/107 |
| 5,662,013 | A | 9/1997 | Lin | 81/490 |
| D385,172 | S | 10/1997 | Bramsiepe et al. | D8/83 |
| D386,955 | S | 12/1997 | Jones et al. | |
| D388,609 | S | 1/1998 | Chan | |
| 5,711,042 | A | 1/1998 | Chuang | 7/138 |
| D394,792 | S | 6/1998 | Bourque | |

D394,794 S 6/1998 Vasudeva ..... D8/107
5,758,870 A * 6/1998 Weaver ..... 269/329
5,765,247 A 6/1998 Seber et al. ..... 7/128
5,765,454 A 6/1998 Barbulescu et al.
5,791,211 A 8/1998 Bondhus et al. ..... 81/440
5,803,584 A 9/1998 Chung
5,820,288 A 10/1998 Cole
D400,775 S 11/1998 Hsu ..... D8/107
5,855,274 A 1/1999 Piao
D405,335 S 2/1999 Lin ..... D8/82
5,911,799 A 6/1999 Johnson et al. ..... 81/177.4
5,916,277 A 6/1999 Dallas ..... 7/128
5,916,341 A 6/1999 Lin
5,918,513 A 7/1999 Ho
5,918,741 A 7/1999 Vasudeva
5,970,828 A 10/1999 Bondhus et al. ..... 81/440
D415,946 S 11/1999 Tsai ..... D8/107
5,983,759 A 11/1999 Turner
5,992,626 A 11/1999 Anderson ..... 206/378
D420,885 S 2/2000 Lin ..... D8/107
D426,449 S 6/2000 Eklind ..... D8/107
D426,450 S 6/2000 Eklind ..... D8/107
D427,875 S 7/2000 Chiu ..... D8/105
6,085,620 A 7/2000 Anderson et al.
6,088,861 A 7/2000 Sessions et al.
6,089,133 A * 7/2000 Liao ..... 81/438
6,092,656 A 7/2000 Ernst
6,095,018 A 8/2000 Schuster
6,105,767 A 8/2000 Vasudeva
6,119,560 A 9/2000 Anderson et al. ..... 81/440
6,128,981 A 10/2000 Bondhus et al. ..... 81/440
D433,613 S 11/2000 Jialin
D433,910 S 11/2000 Oliver et al.
6,151,998 A * 11/2000 Fu-Hui ..... 81/177.4
D435,415 S 12/2000 Johnson et al. ..... D8/71
6,164,172 A 12/2000 Huang ..... 81/490
D435,773 S 1/2001 Lin ..... D8/83
D437,541 S 2/2001 Hermansen et al. ..... D8/105
D437,763 S 2/2001 Oliver et al.
6,186,785 B1 2/2001 Rogers et al.
6,206,189 B1 3/2001 Huot, Jr. et al.
6,233,769 B1 5/2001 Seber et al. ..... 7/128
6,237,451 B1 5/2001 Wei
6,257,106 B1 7/2001 Anderson et al.
6,279,434 B1 8/2001 Brown
6,279,435 B1 8/2001 Zayat, Jr.
D448,267 S 9/2001 Jean et al. ..... D8/105
6,308,599 B1 10/2001 Fu-Hui
6,311,587 B1 11/2001 Johnson et al. ..... 81/177.4
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,357,068 B1 3/2002 Seber et al.
D455,630 S 4/2002 Chiu
6,382,057 B1 5/2002 Kienholz
6,389,931 B1 5/2002 Delaney et al.
6,397,709 B1 6/2002 Wall
6,401,576 B1 6/2002 Wu
6,405,620 B2 6/2002 Liao
D459,967 S 7/2002 Johnson et al. ..... D8/71
D462,002 S 8/2002 Jean et al. ..... D8/105
6,427,564 B1 8/2002 Nelson
6,490,954 B2 12/2002 Johnson et al. ..... 81/177.4
6,510,766 B1 1/2003 Lin ..... 81/177.4
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 * 7/2003 Cunningham ..... 81/177.4
D479,963 S 9/2003 Chang ..... D8/21
6,640,675 B1 11/2003 Chuang
6,675,678 B2 1/2004 Liu
6,698,318 B2 3/2004 Peters ..... 81/177.4
6,701,813 B2 * 3/2004 Hu ..... 81/467
6,739,224 B1 5/2004 Wershe
6,751,819 B2 6/2004 Chuang ..... 7/100
6,752,046 B1 6/2004 Lee
6,758,350 B2 7/2004 Lin
6,763,744 B2 7/2004 Johnson et al. ..... 81/177.4
D494,438 S 8/2004 Falkenstein et al. ..... D8/105
6,799,490 B1 10/2004 Chu
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al. ..... 81/177.4
6,948,406 B1 9/2005 Li
6,968,758 B2 11/2005 Lin
D517,391 S 3/2006 Leins ..... D8/105
7,028,593 B1 4/2006 Lin et al.
7,051,629 B2 5/2006 Huang
D523,637 S 6/2006 Chang
7,073,418 B2 7/2006 Kuo
7,080,582 B2 * 7/2006 Karle ..... 81/477
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al. ..... 81/440
7,143,669 B2 12/2006 Hu
7,150,208 B2 12/2006 Debley
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,216,569 B2 5/2007 Abdelgany
7,237,463 B1 7/2007 Lee
D548,464 S 8/2007 Lin
D549,069 S 8/2007 Lin et al. ..... D8/105
7,281,454 B2 10/2007 Johnson et al. ..... 81/177.4
7,284,466 B1 10/2007 Ho
D557,099 S 12/2007 Lin
7,305,908 B2 12/2007 Chi ..... 81/177.4
7,467,574 B1 12/2008 Lin
7,467,575 B2 12/2008 Lai
7,565,852 B2 7/2009 Yu
7,743,685 B2 6/2010 Chang
D623,037 S 9/2010 Johnson et al.
7,810,415 B2 10/2010 Adamany et al.
7,836,534 B2 11/2010 Simmons
7,946,203 B2 5/2011 Johnson et al.
8,011,277 B2 9/2011 Johnson et al.
8,015,642 B1 9/2011 Oakley
D650,257 S 12/2011 Royes et al.
2001/0005576 A1 6/2001 Rogers et al.
2001/0045145 A1 11/2001 Legg
2003/0047474 A1 3/2003 Dahlson
2003/0126957 A1 7/2003 Huang
2003/0188610 A1 10/2003 Lin
2003/0226428 A1 * 12/2003 Liu ..... 81/177.2
2004/0050218 A1 * 3/2004 Napoli ..... 81/176.2
2004/0173061 A1 9/2004 Liou
2004/0262344 A1 12/2004 White
2005/0011318 A1 1/2005 Tsai
2005/0199108 A1 9/2005 Jheng
2005/0229752 A1 10/2005 Nickipuck
2005/0247587 A1 11/2005 Holland-Letz
2005/0268752 A1 12/2005 Johnson et al. ..... 81/177.4
2006/0101955 A1 5/2006 Chang ..... 81/490
2006/0118500 A1 6/2006 Chen
2006/0150784 A1 7/2006 Hsieh
2006/0213059 A1 9/2006 Eggert ..... 29/857
2006/0288823 A1 12/2006 Schepman
2007/0023306 A1 2/2007 Lai
2007/0056872 A1 3/2007 Begim
2007/0151402 A1 7/2007 Schneeman et al.
2007/0221017 A1 9/2007 Heaven
2007/0228672 A1 10/2007 Huang
2007/0245862 A1 10/2007 Gonzalez et al.

| | | | |
|---|---|---|---|
| 2007/0295171 | A1 | 12/2007 | Johnson et al. |
| 2008/0128370 | A1 | 6/2008 | Shih |
| 2008/0148909 | A1 | 6/2008 | Lai |
| 2008/0156754 | A1 | 7/2008 | Cheng |
| 2008/0164171 | A1 | 7/2008 | Meng |
| 2008/0190249 | A1 | 8/2008 | Yu |
| 2008/0202963 | A1 | 8/2008 | Liao |
| 2008/0251402 | A1 | 10/2008 | Chiu |
| 2008/0271573 | A1 | 11/2008 | Lown et al. |
| 2008/0295657 | A1 | 12/2008 | Cluthe |
| 2009/0107303 | A1 | 4/2009 | Steinweg et al. |
| 2009/0183608 | A1 | 7/2009 | Johnson et al. |
| 2009/0183609 | A1 | 7/2009 | Johnson et al. |
| 2009/0241740 | A1 | 10/2009 | Heagerty |
| 2011/0000024 | A1 | 1/2011 | Johnson et al. |
| 2012/0012485 | A1 | 1/2012 | Wang |

FOREIGN PATENT DOCUMENTS

| | | | |
|---|---|---|---|
| DE | 37 44 176 | A1 | 8/1989 |
| EP | 503 559 | A1 | 9/1992 |
| EP | 618 046 | A1 | 10/1994 |
| FR | 787512 | | 9/1935 |
| GB | 856223 | | 12/1960 |
| JP | 55-045442 | U | 3/1980 |
| JP | 57-13165 | | 1/1982 |
| JP | 3-47775 | | 5/1991 |
| JP | 4-29368 | | 3/1992 |
| JP | 5-31882 | | 4/1993 |
| WO | WO 83/01406 | | 4/1983 |
| WO | WO 97/29887 | | 8/1997 |

* cited by examiner

TOOL HOLDER

FIELD OF THE INVENTION

The present invention relates to the field of hand held tools. More specifically, the present invention relates to the field of T-handle tools and related safety, comfort, and convenience of accessories and tools.

BACKGROUND OF THE INVENTION

T-handle tools have a T-shaped body, including a long leg member and a short handle member. T-handles usually have hexagonal-shaped tips for use with screws and other objects designed to accept a hexagonal tip. Once inserted, rotational pressure is applied to the hexagonal wrench in order to tighten or loosen the screw. The leg member and handle of the hexagonal wrench are designed to be in the shape of the letter "T" so that a user is able to grasp the handle with his hand more comfortably.

T-handle tools are manufactured and distributed in multiple English and metric sizes in order to facilitate their use with screw heads of multiple sizes. Such tools are usually sold in a set which includes tools of multiple sizes but are also distributed individually.

When using a T-handle tool, a user will insert a leg end of the T-handle tool into the head of a workpiece such as a screw, and will then exert rotational pressure using the handle on the handle end of the tool in order to tighten or loosen the screw. Due to the shape of the T-handle tool it is particularly difficult to quickly turn a T-handle tool because the user must constantly remove and replace his hand on the handle as it turns. Furthermore, the handle is usually not very easy to grip.

SUMMARY OF THE INVENTION

A tool handle includes a cavity to receive a T-handle tool. When the tool handle is placed on the T-handle tool, the tool handle provides a better grip of the tool handle to apply greater torque. The tool handle includes a protrusion which is able to detachably couple with the T-handle tool. Once coupled with the T-handle tool, the tool handle is able to be grasped by a user to rapidly turn the T-handle tool. In some embodiments, the T-handle tool includes an added tool. A tool container is able to store T-handle tools and the tool handle. The tool container includes a locking mechanism to lock the tools in place and a tamper prevention mechanism to ensure the locking mechanism is not tampered with while the tool container is in the store.

In one aspect of the present invention, a tool handle comprises a tool handle body and a protruding member extending from the tool handle body, the protruding member configured to be inserted into a T-handle tool. The tool handle body further comprises a cavity for the tool handle to detachably couple with the T-handle tool. The T-handle tool contains a receiving aperture for receiving the protruding member. In some embodiments, the protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The T-handle tool further comprises a leg member and an arm member.

In another aspect of the present invention, a tool system comprises a T-handle tool and a tool handle further comprising a tool handle body and a protruding member extending from the tool handle body, the protruding member configured to be inserted into the T-handle tool. The tool handle body further comprises a cavity for the tool handle to detachably couple with the T-handle tool. The T-handle tool contains a receiving aperture for receiving the protruding member. In some embodiments, the protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The T-handle tool further comprises a leg member and an arm member.

In yet another aspect of the present invention, a T-handle tool comprises a T-handle tool body and a receiving aperture contained within the T-handle tool body, the receiving aperture for receiving a protruding member of a tool handle. The tool handle further comprises a tool handle body which contains a cavity for the tool handle to detachably couple with the T-handle tool. The protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The T-handle tool further comprises a leg member and an arm member. The T-handle tool further comprises a rotating collar for stabilizing the T-handle tool body when the T-handle tool body is rotating.

In still yet another aspect of the present invention, a T-handle tool container comprises a tool container body configured to hold a group of one or more T-handle tools of multiple sizes securely upon insertion and a locking mechanism configured to lock the group of one or more T-handle tools within the tool container body.

In another aspect of the present invention, a method of storing a group of one or more T-handle tools securely, comprises inserting the group of one or more T-handle tools into a tool container, locking the group of one or more T-handle tools into the tool container with a locking mechanism and securing the locking mechanism in a locked position with a tamper prevention mechanism.

In yet another aspect of the present invention, a tool set comprises a group of one or more T-handle tools, a tool handle configured for detachably coupling with each of T-handle tools in the group of one or more T-handle tools and a tool container for storing the tool handle and the group of one or more T-handle tools.

DETAILED DESCRIPTION OF THE PREFERRED EMBODIMENT

A tool handle aids a user in gripping a T-handle tool and includes a protrusion for inserting into the T-handle tool to then rotate the T-handle tool. A T-handle tool includes a handle component, a rotating collar and a leg which includes a tool such as a hexagonal wrench end. A modified T-handle tool includes an arm to include an added tool such as another hexagonal wrench. A tool container stores the T-handle tools. In some embodiments, the tool container includes a locking mechanism for locking the tools in place. In some embodiments, the tool container also includes a tamper prevention mechanism for preventing the locking mechanism from being tampered with.

Figure 1A:
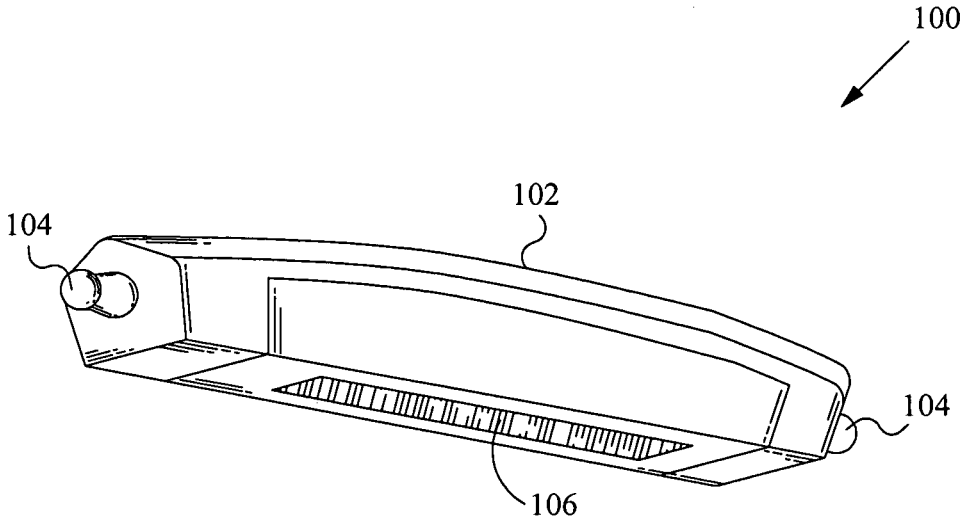
FIG. 1A illustrates a perspective view of a tool handle.

FIG. 1A illustrates a perspective view of a tool handle 100. The tool handle 100 includes a tool handle body 102, one or more protruding members 104 and a cavity 106. The tool handle body 102 comprises any material, including but not limited to, rubber, metal, wood and plastic. The tool handle body 102 is large enough to fit around a T-handle tool but not too large for a user to grasp comfortably. Specifically, in some embodiments, the tool handle body 102 is slightly longer and wider than the handle of the T-handle tool. In some embodiments, the tool handle body 102 is substantially rectangular. In some embodiments, the protruding members 104 extend from the tool handle body 102 at opposing ends. The protruding members 104 comprise any material, including but not limited to, rubber, metal, wood and plastic. In some embodiments, the protruding members 104 are rounded. The cavity 106 is shaped and sized to receive a T-handle tool 200 (FIG. 2A) so that the tool handle 100 is detachably coupled with the T-handle tool 200 (FIG. 2A).

Figure 1B:
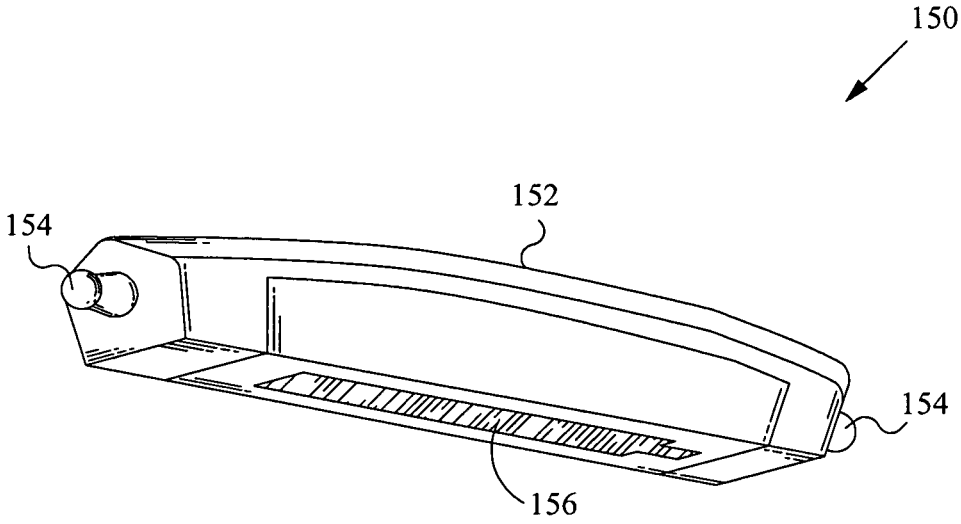
FIG. 1B illustrates a perspective view of a modified tool handle.

FIG. 1B illustrates a perspective view of a modified tool handle 150. The tool handle 150 includes a tool handle body 152, one or more protruding members 154 and a cavity 156. The tool handle body 152 comprises any material, including but not limited to, rubber, metal, wood and plastic. The tool handle body 152 is large enough to fit around a T-handle tool but not too large for a user to grasp comfortably. Specifically, in some embodiments, the tool handle body 152 is slightly longer and wider than the handle of the T-handle tool. In some embodiments, the tool handle body 152 is substantially rectangular. In some embodiments, the protruding members 154 extend from the tool handle body 152 at opposing ends. The protruding members 154 comprise any material, including but not limited to, rubber, metal, wood and plastic. In some embodiments, the protruding members 154 are rounded. The cavity 156 is shaped and sized to receive a modified T-handle tool 250 (FIG. 2B) so that the tool handle 150 is detachably coupled with the modified T-handle tool 250 (FIG. 2B).

Figure 2A:
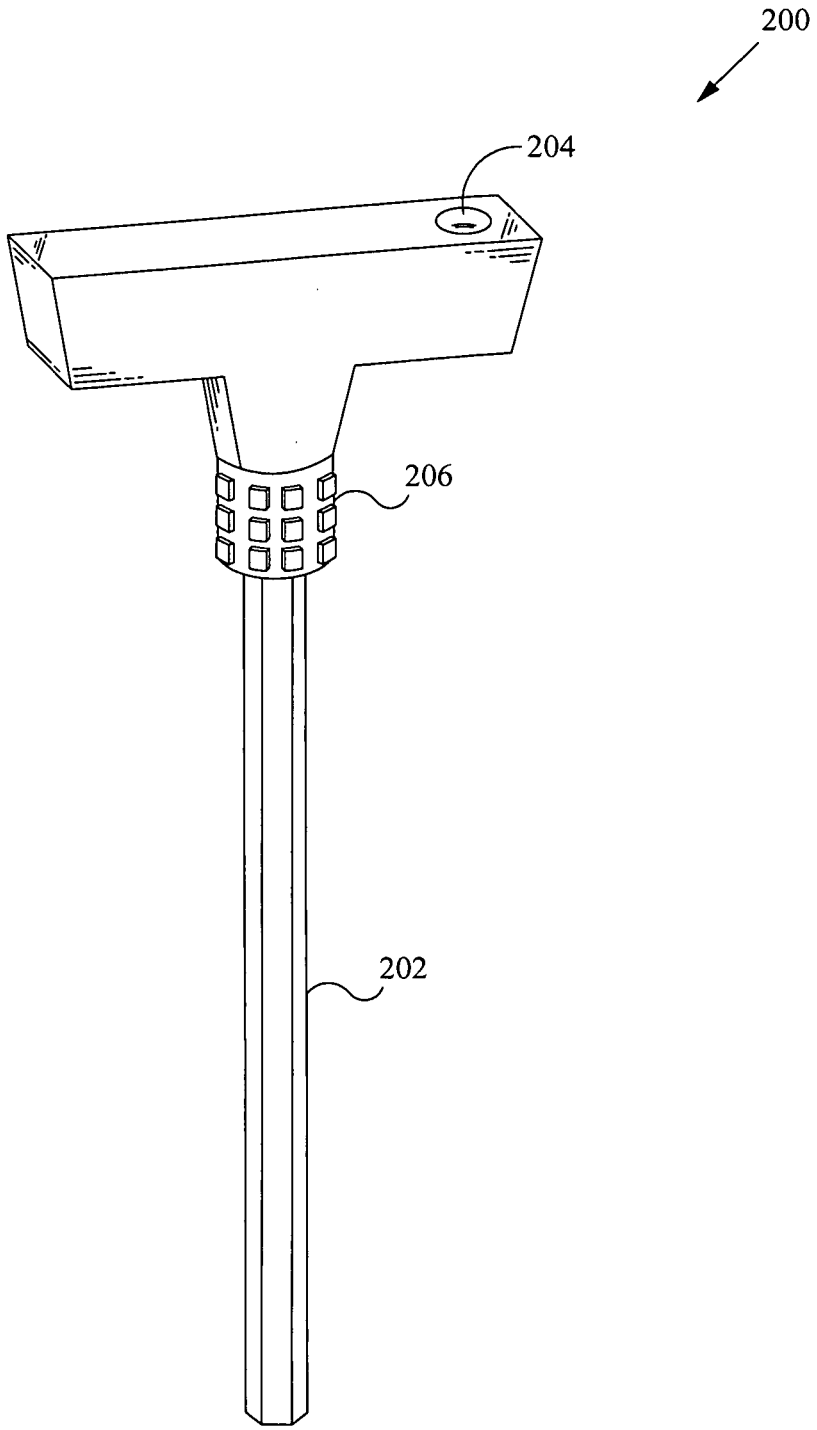
FIG. 2A illustrates a perspective view of a T-handle tool.

FIG. 2A illustrates a perspective view of a T-handle tool 200. The T-handle tool 200 includes a T-handle tool body 202 and a receiving aperture 204. The T-handle tool body 202 further includes a handle component and a leg component. A rotating collar 206 near the base of the handle component allows a user to stabilize the tool while turning the handle component. The rotating collar 206 is held in place by the user while the handle is turned. In some embodiments, the rotating collar 206 has ridges or small grooves. In some embodiments, the receiving aperture 204 is rounded. In some embodiments, the receiving aperture 204 is located on the top and near an end of the handle component of the T-handle tool body 202. In some embodiments, there are two or more receiving apertures 204, one at each end of the handle component. In some embodiments, the leg component includes a hexagonally-shaped head. The receiving aperture 204 is configured to receive a protruding member 104 (FIG. 1) of the tool handle 100 (FIG. 1).

Figure 2B:
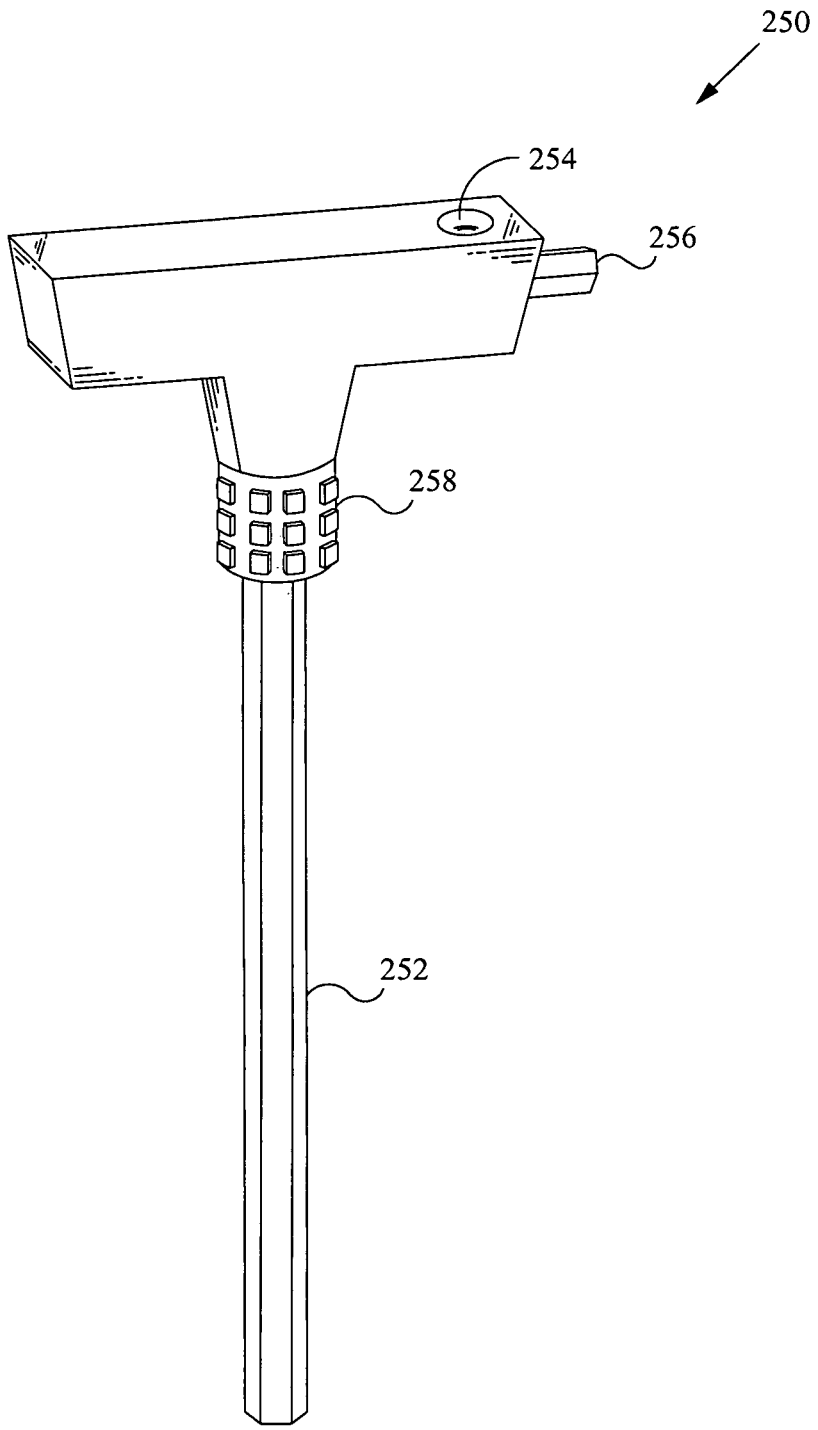
FIG. 2B illustrates a perspective view of a modified T-handle tool.

FIG. 2B illustrates a perspective view of a modified T-handle tool 250. The T-handle tool 250 includes a T-handle tool body 252, a receiving aperture 254 and an arm 256. The T-handle tool body 252 further includes a handle component and a leg component. A rotating collar 258 near the base of the handle component allows a user to stabilize the tool while turning the handle component. The rotating collar 258 is held in place by the user while the handle is turned. In some embodiments, the rotating collar 258 has ridges or small grooves. In some embodiments, the receiving aperture 254 is rounded. In some embodiments, the receiving aperture 254 is located on the top and near an end of the handle component of the T-handle tool body 252. In some embodiments, there are two receiving apertures 254 or more, one at each end of the handle component. In some embodiments, the leg component includes a hexagonally-shaped head. The receiving aperture 254 is configured to receive a protruding member 104 (FIG. 1) of the tool handle 100 (FIG. 1). In some embodiments, the arm 256 extends out from the handle component of the T-handle tool 200. In some embodiments, the arm 256 includes a hexagonally-shaped end.

Figure 3A:
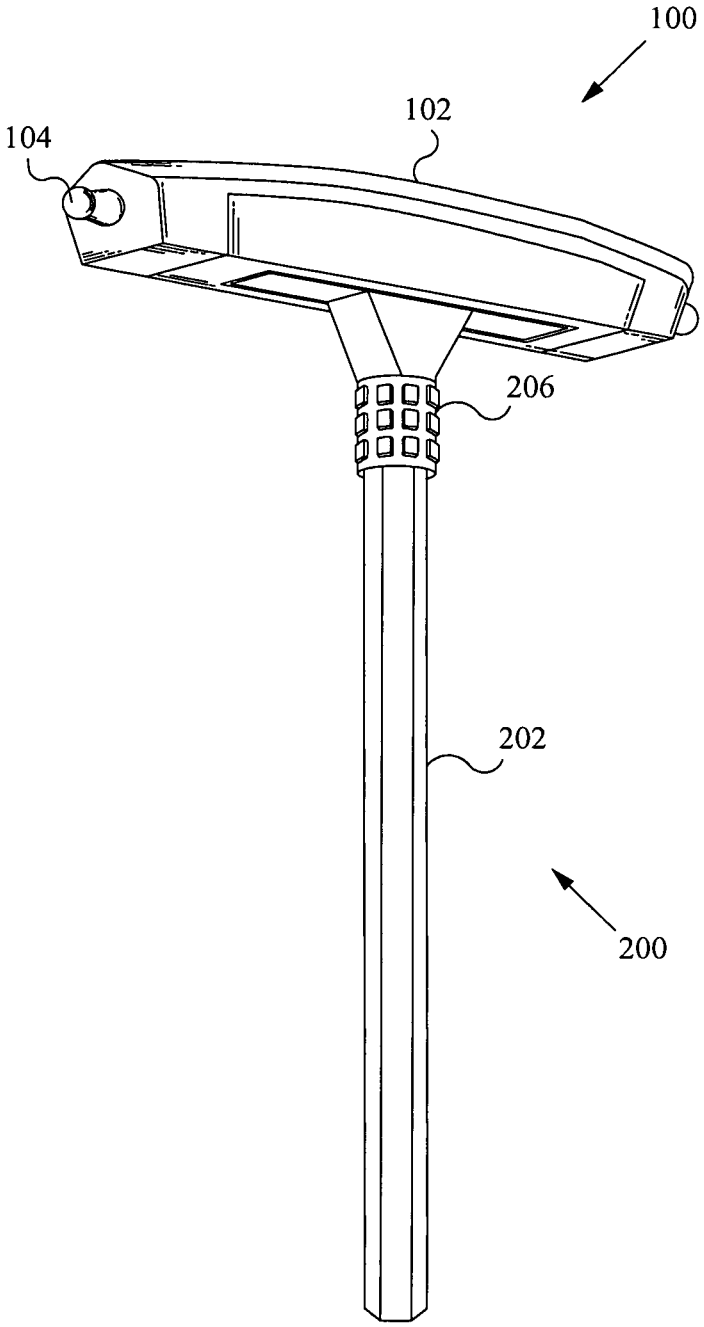
FIG. 3A illustrates a perspective view of a tool handle detachably coupled with a T-handle tool.

FIG. 3A illustrates a perspective view of a tool handle 100 detachably coupled with a T-handle tool 200. Specifically, the handle component of the T-handle tool body 202 is positioned within the cavity 106 (FIG. 1) of the tool handle body 102. When the T-handle tool body 202 is positioned within the cavity 106 (FIG. 1) of the tool handle body 102, a user has a larger handle to grip, thus making the T-handle tool 200 easier to grip and enabling the user to apply more torque with the T-handle tool 200. The user is also able to stabilize the T-handle tool 200 by holding a rotating collar 206.

Figure 3B:
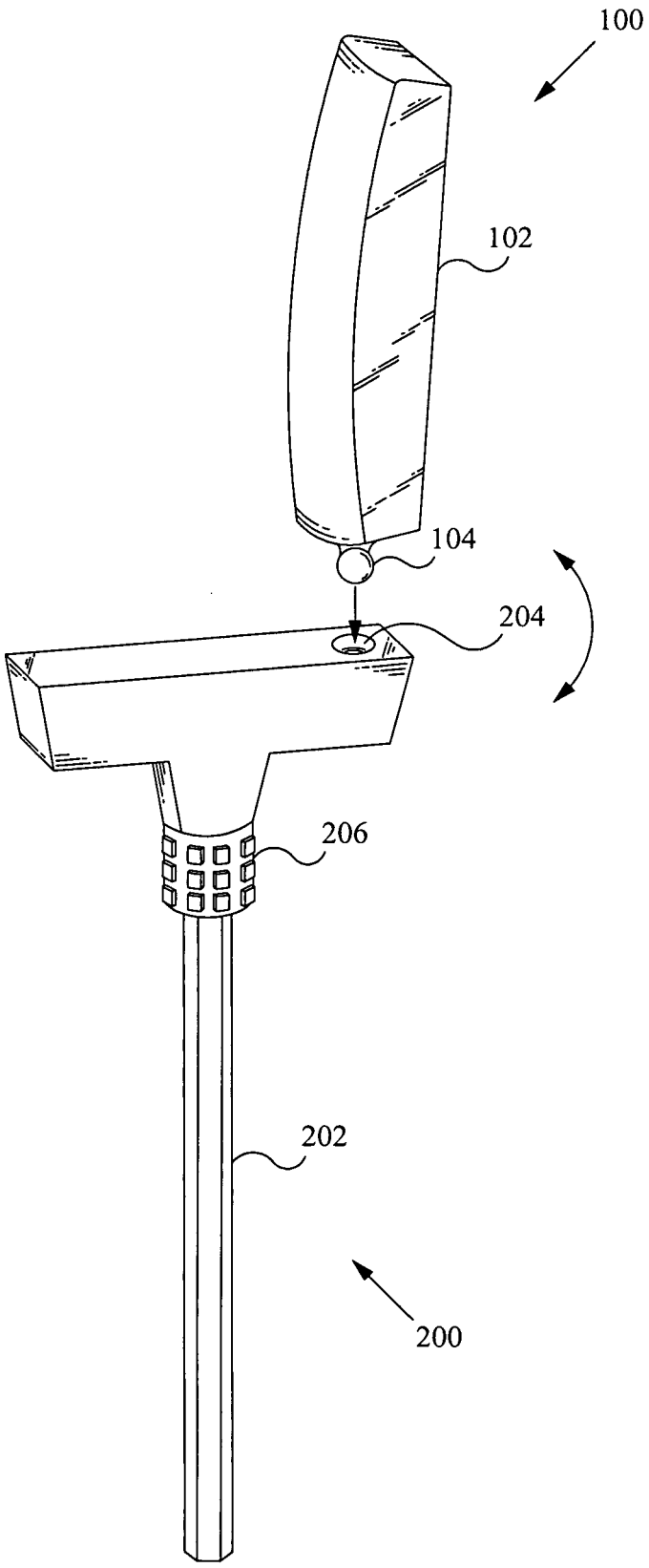
FIG. 3B illustrates a perspective view of a tool handle positioned to rotate the T-handle tool.

FIG. 3B illustrates a perspective view of a tool handle 100 positioned to rotate the T-handle tool 200. With the tool handle body 102 positioned lengthwise in the same direction as the plane of the T-handle tool body 202, the protruding member 104 is able to be positioned in the receiving aperture 204 of the T-handle tool 200. A user is then able to move the tool handle 100 in a circular motion which causes the T-handle tool 200 to rotate. By using the protruding member 104 and the aperture 204, the user does not have to keep removing his hand after every rotation of the T-handle tool 200. Furthermore, it is possible to move the tool handle 100 in a circular motion much faster than simply turning one's hands. Therefore, using the T-handle tool 200 with the tool handle 100 in this position, a user is able to much more rapidly rotate the T-handle tool 200 which is likely being used to install or remove a screw or another object. The user is also able to stabilize the T-handle tool 200 by holding a rotating collar 206.

Figure 4A:
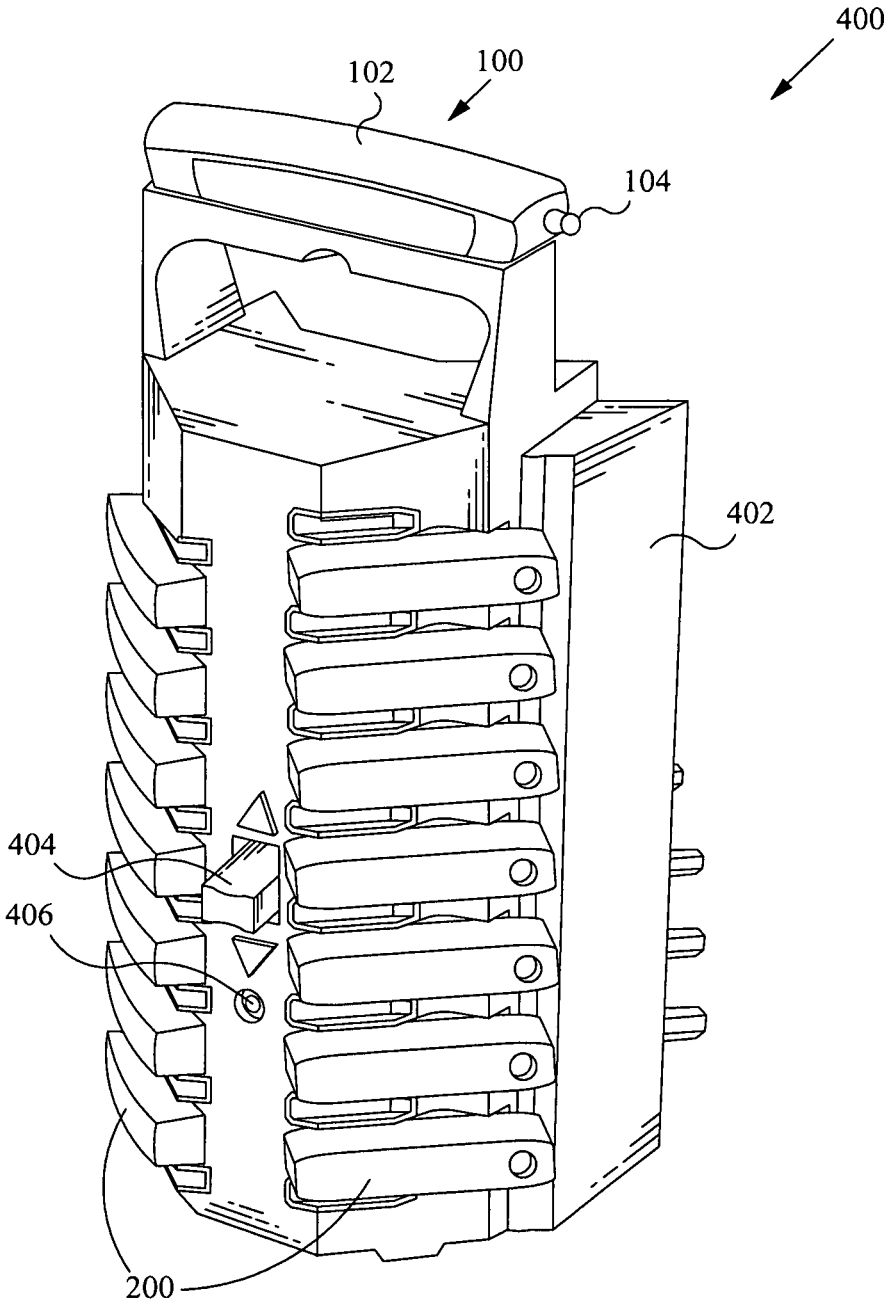
FIG. 4A illustrates a front side view of a tool container for storing a group of one or more T-handle tools.

FIG. 4A illustrates a front side view of a tool container 400 for storing a group of one or more T-handle tools 200. The tool container 400 includes a tool container body 402 with receiving slots/apertures 410 (FIG. 4C) for receiving each of the T-handle tools 200. In some embodiments, there are other means for receiving each of the T-handle tools 200. In some embodiments, the receiving slots 410 (FIG. 4C) are configured in columns with one column for storing Standard American Equivalent-sized tools and the second column for storing metric-sized tools. The tool container 400 also includes a receiving member 408 (FIG. 4C) for receiving a tool handle 100. A handle of the tool container 400 is configured to allow the tool container 400 to be hung in a store for display. A locking mechanism 404 is included within the tool container 400 to lock the tools 200 within the tool container 400. The locking mechanism 404 includes a tab which is able to be toggled between a lock and an unlock position. The locking mechanism 404 also includes a plate 412 (FIG. 4D) that is movable into locked and unlocked positions, where in the locked position, the plate 412 (FIG. 4D) applies pressure on the rotating collar of the T-handle tools, so that they are not removable. When the tools 200 are locked in place, they are unable to be removed or fall out from the tool container 400. A tamper prevention mechanism 406 is included within the tool container 400 to ensure the locking mechanism 404 is not tampered with. The tamper prevention mechanism 406 is any device which prevents the locking mechanism 404 from being moved such as a screw which secures the locking mechanism plate 412 (FIG. 4D) in place. For example, while a tool container is in a retail store to be sold, the locking mechanism is in the "lock" position, so that the tools are not able to be removed and stolen. To prevent someone from simply toggling the locking mechanism to the "unlock" position, the tamper prevention mechanism is used. With the tamper prevention mechanism in place, a would-be thief would have to bring a screwdriver, spend the time to remove the screw and then move the switch to the "unlock" position to steal a tool. Thus, the locking mechanism used in conjunction with the tamper prevention mechanism is sufficient to securely display the tool container and tools without having to worry about them being stolen. When the tools, the handle and the container are together they form a set.

Figure 4B:
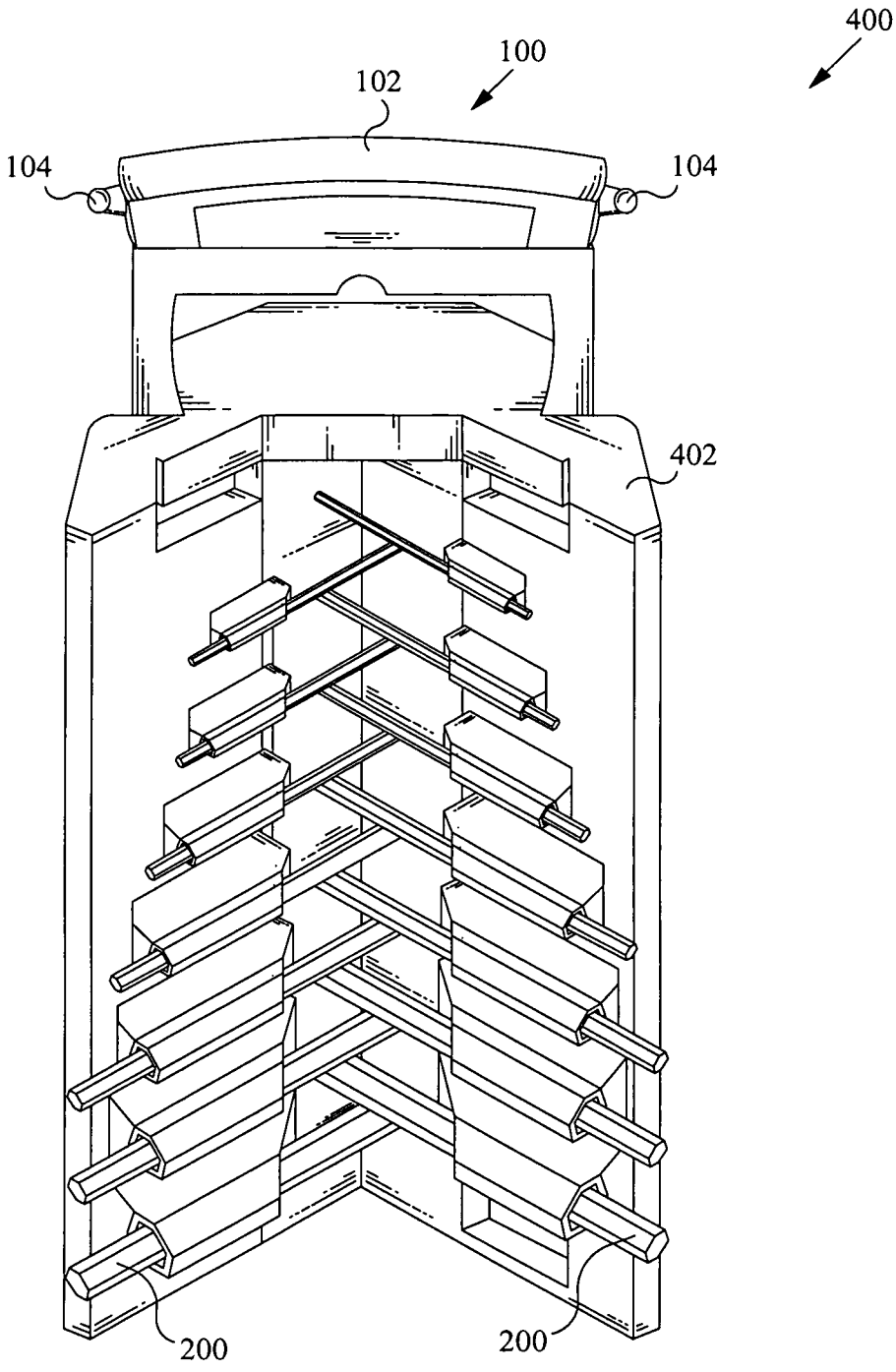
FIG. 4B illustrates a back view of a tool container for storing a group of one or more T-handle tools.

FIG. 4B illustrates a back view of a tool container 400 for storing a group of one or more T-handle tools 200. As described, in some embodiments, the tools 200 are stored in two columns. To minimize the size of the tool container 400, the tools 200 are stored in a criss-cross configuration, in some embodiments.

Figure 4C:
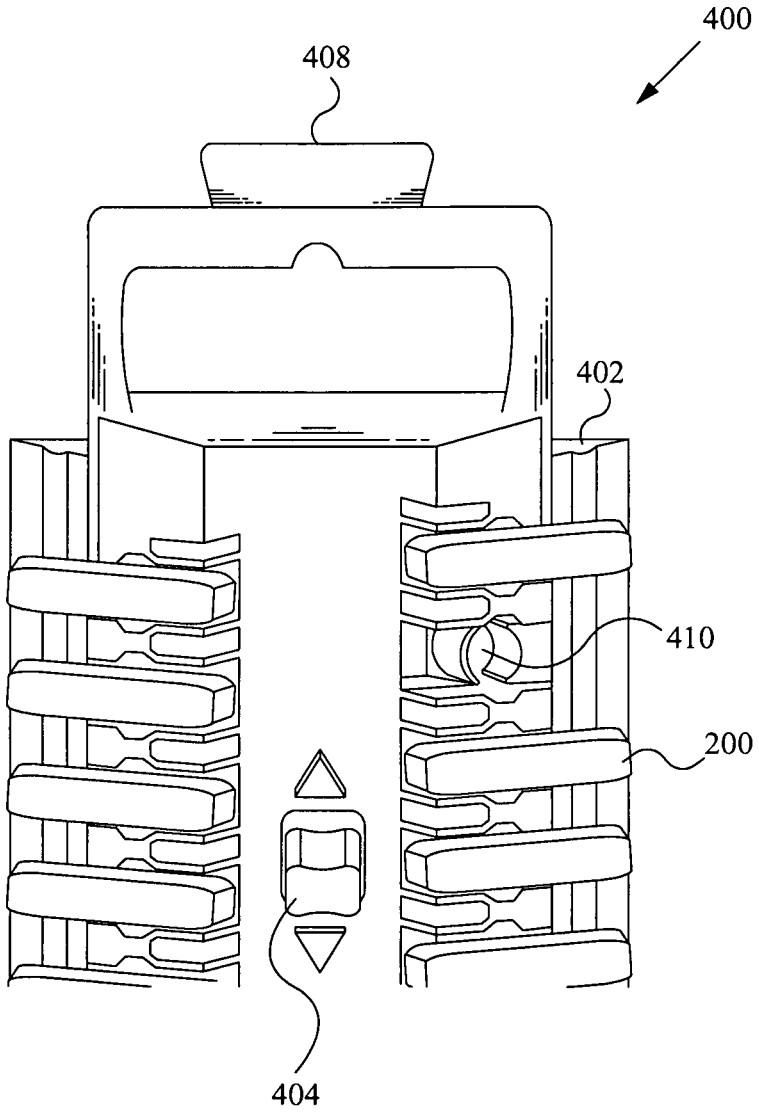
FIG. 4C illustrates a view of part of a tool container for storing a group of one or more T-handle tools.

FIG. 4C illustrates a view of part of a tool container 400 for storing a group of one or more T-handle tools 200. A receiving member 408 allows a tool handle 200 to be stored on the tool container 400. A receiving slot 410 is where a T-handle tool 200 is inserted to be stored in the tool container 400.

Figure 4D:
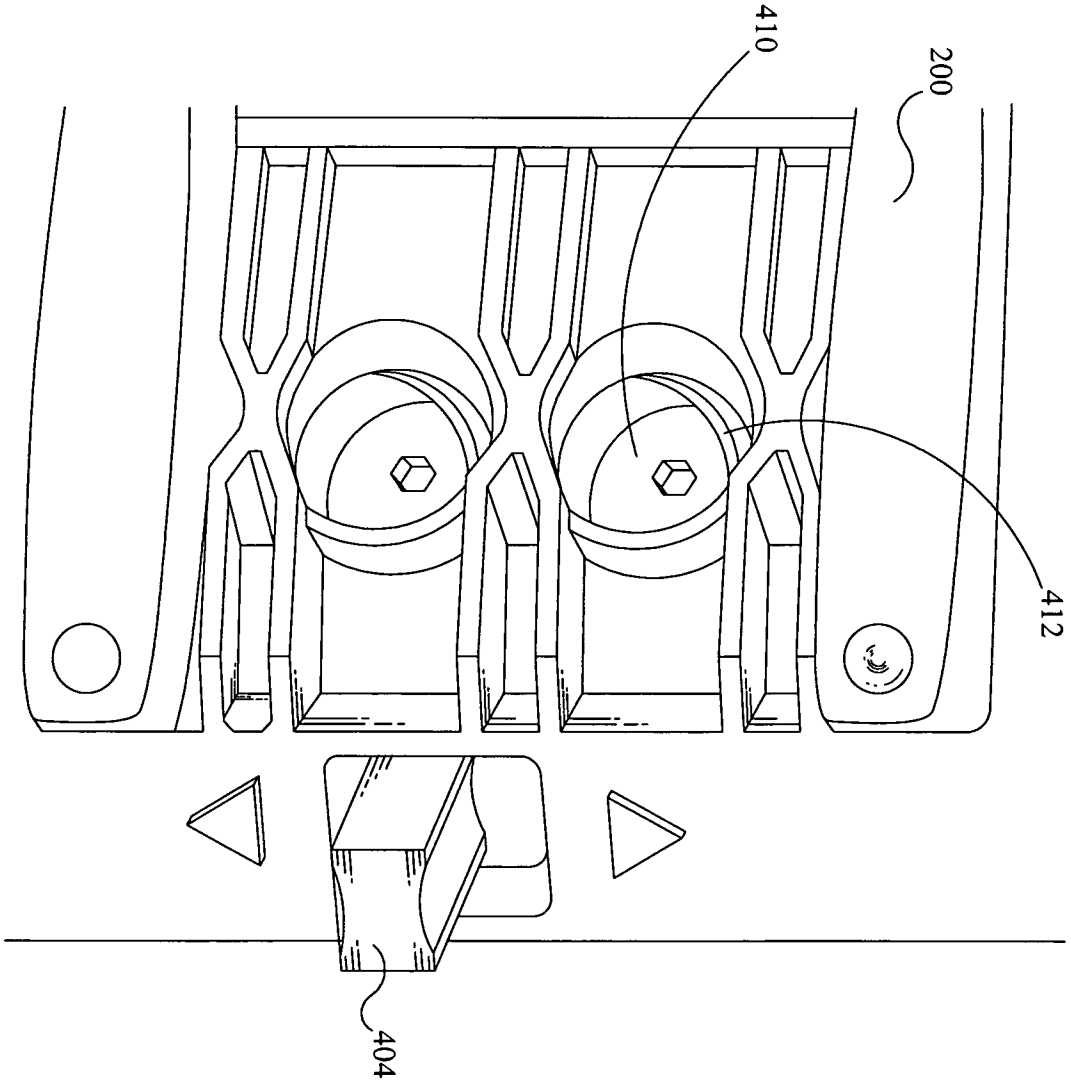
FIG. 4D illustrates a close-up view of part of a tool container for storing a group of one or more T-handle tools.

FIG. 4D illustrates a close-up view of part of a tool container 400 for storing a group of one or more T-handle tools 200. A locking mechanism plate 412 which is able to be part of a locking mechanism 404 locks the tools 200 in place by applying pressure against the rotating collar of the T-handle tool 200. The locking mechanism plate 412 is moved by moving a locking mechanism tab. The locking mechanism plate 412 moves against the rotating collar of each T-handle tool 200 and applies pressure against the rotating collar, when the locking mechanism 404 is in the "lock" position. When the locking mechanism 404 is in the "unlock" position, the locking mechanism plate 412 is moved away from the rotating collar of each T-handle tool 200 which relieves the pressure against the rotating collar, thus allowing the T-handle tool 200 to be removed. In some embodiments, the locking mechanism is implemented by other means.

Figure 4E:
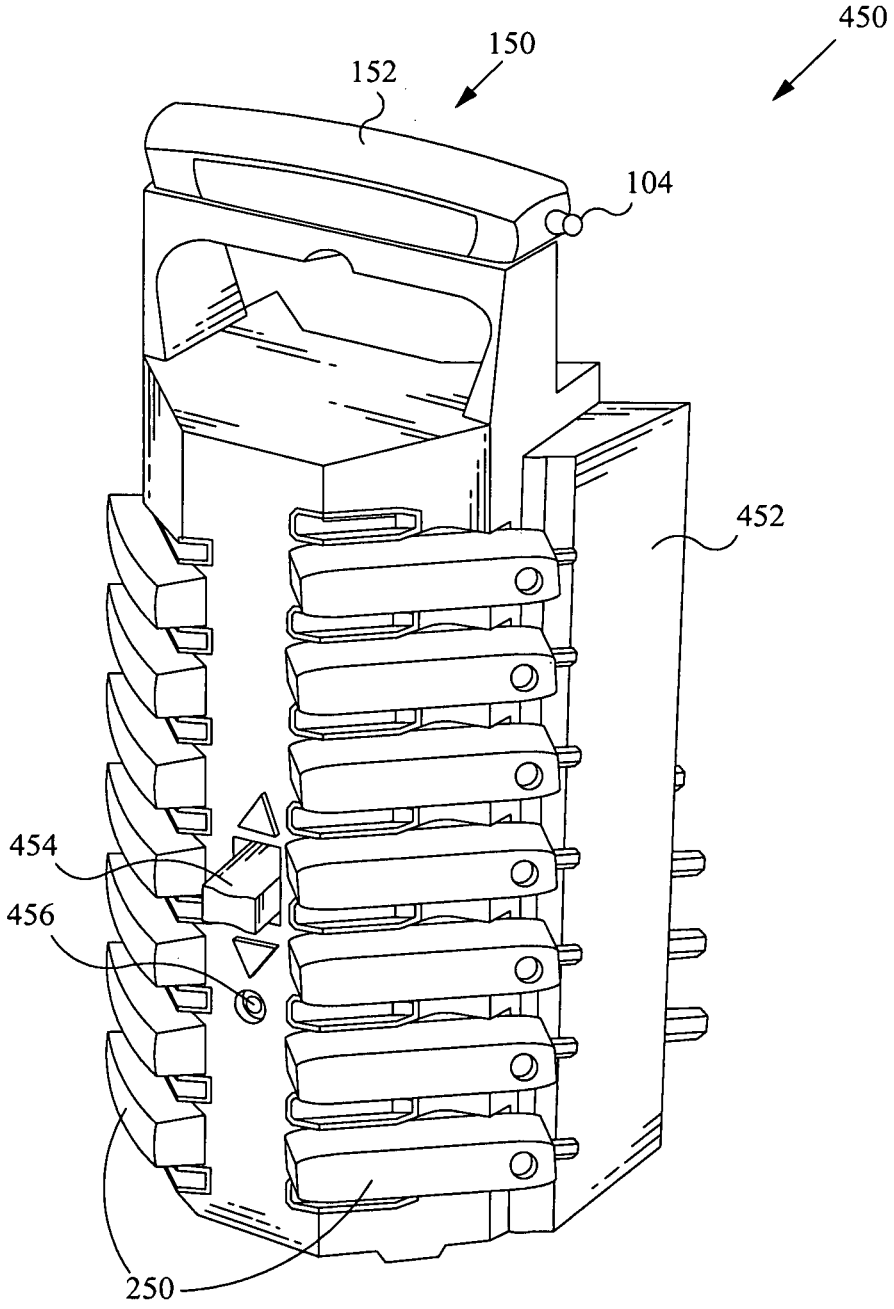
FIG. 4E illustrates a front side view of a tool container for storing a group of one or more T-handle tools.

FIG. 4E illustrates a front side view of a tool container 450 for storing a group of one or more T-handle tools 240. The tool container 450 includes a tool container body 452 with receiving slots/apertures 410 (FIG. 4C) for receiving each of the T-handle tools 250. In some embodiments, there are other means for receiving each of the T-handle tools 250. In some embodiments, the receiving slots 410 (FIG. 4C) are configured in columns with one column for storing Standard American Equivalent-sized tools and the second column for storing metric-sized tools. The tool container 450 also includes a receiving member 408 (FIG. 4C) for receiving a tool handle 150. In some embodiments, the receiving member is shaped more similarly to the aperture 156 (FIG. 1B). A handle of the tool container 450 is configured to allow the tool container 450 to be hung in a store for display. A locking mechanism 454 is included within the tool container 450 to lock the tools 250 within the tool container 450. The locking mechanism 454 includes a tab which is able to be toggled between a lock and an unlock position. The locking mechanism 454 also includes a plate that is movable into locked and unlocked positions, where in the locked position, the plate applies pressure on the rotating collar component of the T-handle tools, so that they are not removable. When the tools 250 are locked in place, they are unable to be removed or fall out from the tool container 450. A tamper prevention mechanism 456 is included within the tool container 450 to ensure the locking mechanism 454 is not tampered with. The tamper prevention mechanism 456 is any device which prevents the locking mechanism 454 from being moved such as a screw which secures the locking mechanism plate in place.

Figure 5:
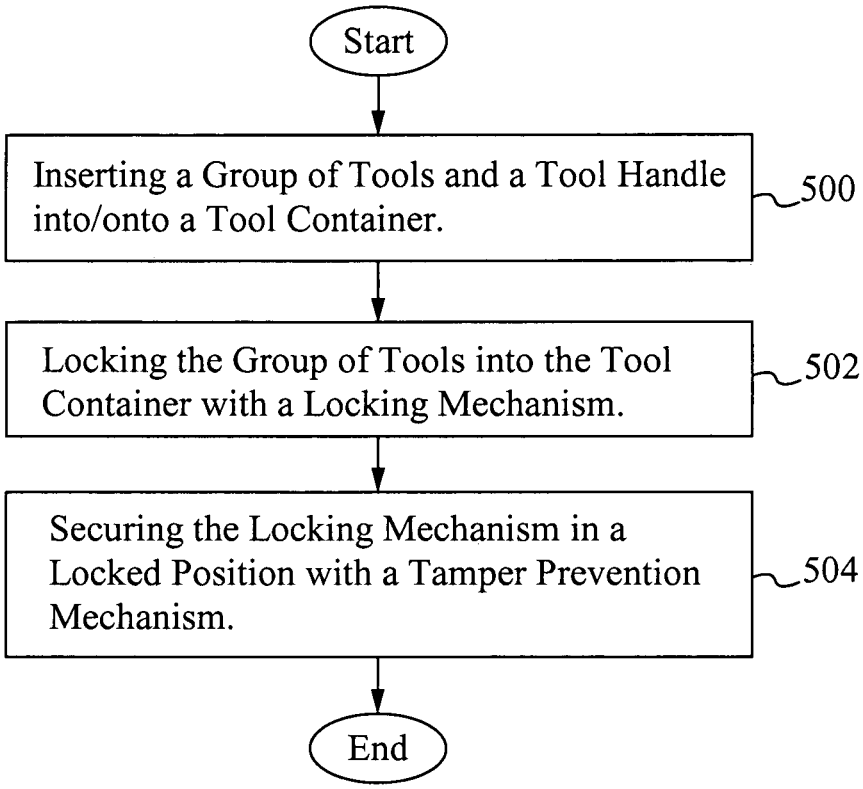
FIG. 5 illustrates a flowchart of a method of securing a group of one or more tools in a tool container.

FIG. 5 illustrates a flowchart of a method of securing a group of one or more tools in a tool container 400. In the step 500, the group of one or more tools 200 is inserted into the tool container 400. In some embodiments, a set of metric tools are inserted into a first column of the tool container 400 and a set of standard tools are inserted into a second column of the tool container 400. In some embodiments, a tool handle 100 is also inserted onto the tool container 400. In the step 502, the group of one or more tools 200 is locked within the tool container 400 with a locking mechanism 404. The locking mechanism 404 is locked by moving a locking tab into a "lock" position. In the step 504, the locking mechanism is secured in a locked position with a tamper prevention mechanism 406. With the tool container 400 secured in a locked position, the tools are not removable. A same or similar method is used to store the modified tools 250 and the modified tool handle 150 in the tool container 450.

The tool handle is utilized by detachably coupling the tool handle and the T-handle tool, and grasping the tool handle and T-handle tool combination with one hand. Specifically, the T-handle tool is placed within the cavity of the tool handle. The tool handle is also utilized to more quickly rotate the T-handle tool by positioning the tool handle appropriately, inserting a protruding member of the tool handle into a receiving aperture of the T-handle tool and then moving the tool handle in a circular motion. The T-handle tool is still utilized as standard T-handle tool to insert or remove an object that is capable of receiving the T-handle tool.

To utilize the tool container one or more tools are inserted into the tool container. A tool handle is also able to be stored with the tool container. The tools are easily accessible in the tool container. Furthermore, while available for purchase, such as in a retail store, a locking mechanism and a tamper prevention mechanism ensure that no tools are stolen from the tool container. After or while the tool container is purchased, a user or a store employee removes the tamper prevention mechanism. Then, the user is able to remove, utilize and return the tools to the tool container as desired. The user is still able to lock the tools within the tool container to ensure the tools do not fall out. In some embodiments, the user is able to retain and reuse the tamper prevention mechanism to lock and ensure, for example, children are unable to access the tools.

In operation, the tool holder provides a larger grip for the T-handle tool. The tool holder is also able to act as a handle to rotate the T-handle tool similar to a hand crank.

In operation, the tool container includes a locking mechanism and a tamper prevention mechanism which are able to be used to allow the tool container and tools to be displayed yet protected from theft without the need for additional packaging. This removes the need for expensive added containment materials such as plastic that goes all around the tool container. Moreover, since the retaining mechanism utilizes less plastic, it is also more environmentally friendly. The tool container after purchase is also able to securely store the tool for easy access and use.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A tool handle comprising:

a. a tool handle body having a front side, a back side, a left side, a right side, a top side, and a bottom side;

b. a protruding member coupled to and extending from an outer portion of the tool handle body on either the left side or the right side and on a different side from a cavity, the protruding member is configured to be inserted into a T-handle tool and an end portion of the protruding member away from the tool handle body is spherical; and c. the cavity on a top side or a bottom side and comprising a single opening comprising two straight long sides within the tool handle body for the tool handle to detachably couple with the T-handle tool.

2. The tool handle of claim 1 wherein the protruding member detachably couples with an aperture of the T-handle tool.

3. The tool handle of claim 1 wherein the tool handle body is longer and wider than the T-handle tool to enable better gripping of the T-handle tool.

4. The tool handle of claim 1 wherein the tool handle body is configured to be positioned lengthwise vertically for rotating the T-handle tool.

5. A tool system comprising:

a. a T-handle tool comprising:

i. a leg member for engaging a workpiece;

ii. a substantially round receiving aperture offset from a center of the T-handle tool; and b. a tool handle comprising:

i. a tool handle body comprising a cavity comprising a single opening within the tool handle body for the tool handle to detachably couple with the T-handle tool; and ii. a protruding member extending from an outer portion of the tool system when the tool handle is coupled with the T-handle tool, the protruding member configured to be inserted into the T-handle tool.

6. The tool system of claim 5 wherein the protruding member is rounded and the receiving aperture is rounded to enable rotating of the T-handle tool.

7. The tool system of claim 5 wherein the tool handle body is longer and wider than the T-handle tool to enable better gripping of the T-handle tool.

8. The tool system of claim 5 wherein the tool handle body is configured to be positioned lengthwise vertically for rotating the T-handle tool.

9. The tool system of claim 5 wherein the T-handle tool comprises the leg member and an arm member.

10. A T-handle tool comprising:

a. a T-handle tool body having a leg member extending only from a first side of the body, the leg member for directly engaging a workpiece; and b. a substantially round receiving aperture positioned on a second side of the T-handle tool body that is opposite the first side and offset from a center of the T-handle tool body, the receiving aperture for releasably receiving a protruding member of a tool handle, wherein the receiving aperture does not pass through the tool body, and wherein the T-handle tool is configured to be used to engage a workpiece when the protruding member is positioned within the aperture and when the protruding member is not positioned within the aperture.

11. The T-handle tool of claim 10 wherein the T-handle tool body is configured to fit within a cavity of the tool handle such that the T-handle can detachably couple to the tool handle.

12. The T-handle tool of claim 11 wherein the T-handle tool is rotatable when the protruding member of the tool handle body is positioned within the receiving aperture.

13. The T-handle tool of claim 11 further comprising an arm member.

14. The T-handle tool of claim 11 further comprising a rotating collar for stabilizing the T-handle tool body when the T-handle tool body is rotating.

15. The T-handle tool of claim 10 wherein the body of the T-handle tool comprises a length and a width, wherein the length is longer than the width and wherein the substantially round receiving aperture is on a first longitudinal plane perpendicular to the length and the leg member is on a second longitudinal plane perpendicular to the length.

16. A tool handle comprising:

a. a tool handle body having a top, a bottom, and two sides;

b. a first and second protruding member, wherein the first protruding member extends from a first side of the tool handle body and the second protruding member extends from a second side of the tool handle body that is opposite the first so that the first protruding member and the second protruding member extend in different directions, wherein an end portion of the first protruding member and the second protruding member away from the tool handle body is substantially spherical; and c. a cavity on the bottom of the tool handle body for the tool handle to detachably and operatively couple with a T-handle tool.

* * * * *